US005224801A

United States Patent [19]

Quaney

[11] Patent Number: 5,224,801

[45] Date of Patent: Jul. 6, 1993

[54] INTERLOCKED GRIDWORK FOR RETAINING WALLS, AND THE LIKE

[76] Inventor: Patrick E. Quaney, 17076 Los Modelos, Fountain Valley, Calif. 92708

[21] Appl. No.: 797,320

[22] Filed: Nov. 25, 1991

[51] Int. Cl.[5] ..... E02D 17/00

[52] U.S. Cl. ..... 405/273; 405/284; 52/169.2; 52/593

[58] Field of Search ..... 405/272, 273, 284, 286; 52/169.2, 169.4, 233, 593; 47/83; 403/338, 346, 347

[56] References Cited

U.S. PATENT DOCUMENTS

| | | | |
|---|---|---|---|
| 1,996,774 | 4/1935 | Powers | 405/273 |
| 3,726,042 | 4/1973 | Haile | 47/83 |
| 4,521,203 | 6/1985 | Rothenberg | 52/233 X |
| 4,664,562 | 5/1987 | Clark et al. | 405/273 |
| 4,997,315 | 3/1991 | Clark | 405/273 |

FOREIGN PATENT DOCUMENTS

| | | | |
|---|---|---|---|
| 2582752 | 12/1986 | France | 403/347 |

*Primary Examiner*—Dennis L. Taylor
*Assistant Examiner*—John Ricci
*Attorney, Agent, or Firm*—Willie Krawitz

[57] ABSTRACT

A gridwork or crib structure is formed from reinforced, injection molded plastic or injection molded structural foam plastic crossbeams, stringers and fascia members by interlocking the members and pinning the stringers together to form a structure which can function as a gravity retaining wall to retain earth, as a structural wall, or as a water wall. The individual crossbeams are laid end-to-end on conventional base footings and define elongated slots and holes into which are connected the stringers, which are then locked and pinned together, thereby forming an initial crib or grid layer at ground level. This crib or grid layer can be built up in height and depth to provide an open structure defining securement channels into which earth is filled. Use of slot and hole connections produce an adjustable interfitted grid which can assume a convex or concave curvature, or the usual linear form, or the grid can form a square corner. Consequently, it is relatively easy to build the crib or grid layers to follow uneven perimeters such as property lines, roads, hill sides, etc. Since the plastic crossbeams and stringers are quite light, it is very easy to erect the crib or grid, compared to working with metal, timber or concrete reinforcement beams. This enables its installation in inaccessible locations, since it does not require heavy equipment for its construction. Also, the opening in fascia elements of the crib or grid enables planting of vegetation into the earth fill for soil retention or decoration.

20 Claims, 5 Drawing Sheets

INTERLOCKED GRIDWORK FOR RETAINING WALLS, AND THE LIKE

BACKGROUND OF THE INVENTION

This invention relates to a new and improved structure formed as a gridwork of interlocked, lightweight, injection molded plastic or injection molded structural foam plastic components. The structure may be used as an earth retaining wall by filling earth in between the plastic components of the gridwork, or the structure may be used simply as a structural wall. When used as an earth retaining wall, the earth in the structure can be stabilized by means of growing vegetation, or by means of earth retaining panels, or both. When used in conjunction with closed fascia, the structure can be used as a water wall to protect earthen banks.

Prior art structures are stabilized by means of the weight of the concrete, timber, metal beams, etc., and with the weight of the retained earth; hence, the term 'gravity wall' is used to describe these structures. These prior art structures are stabilized by the rigidity of the components and also their heavy weight. Thus, the strength of the structure is related to their rigidity and weight a well as the weight of the earth which is retained by the structure.

But the use of timber, metal beams, concrete or building blocks is expensive both in terms of material cost and labor. Also, they are expensive in terms of installation costs due to the weight of the materials employed, since these heavy components require the use of large lifting cranes, heavy powered equipment and manpower.

Various publications of earth retaining wall systems include U.S. Pat. Nos. 4,514,113; 4,661,023; 4,718,792; 4,725,168; 4,798,499; 4,914,876; 4,917,543; 4,929,125; 4,930,939; 4,952,098; 4,961,673; and, 4,968,186. But, these patents involve structures which employ concrete, building blocks, steel or timber as an essential reinforcement, and these prior art components are immobilized in position.

However, when using these prior art components, the round on which the structure is installed may shift due to water absorption, or due to earth movement such as soil subsistence or hill slides, or due to earthquake, etc. Consequently, if the structural components are in a fixed or immobilized position, they will tend to be placed under a greater degree of compressive or tensile stress, and the entire structure could fail or become badly deformed.

Hence, it is desired to provide an earth retaining system which can also function as a structural wall, and which employs inexpensive and lightweight components that may be installed quickly and inexpensively. Also, an earth retaining system is desired in which the components are adjustable, thereby enabling the structure to follow curved o straight lines, and where the components are resilient to earth movement, earthquakes, and the like.

It is also desired to provide a structure that ca shift slightly vertically or horizontally to adjust to ground movement, which gives rise to the term 'diaphragm wall'.

It is also desired to provide a structure which relies solely on lightweight, interlocked components as well as on the weight of earth to maintain stability.

THE INVENTION

According to the invention, an adjustable, interlocked gridwork of structural components is provided useful as an earth retaining wall, or a self supporting structural wall. The gridwork components are adjustable during construction to follow uneven contours of the ground and the perimeter, and to self adjust to subsequent changes in ground support due to earth movement, earthquake, slides, etc., with reduced tendency of the structure to deform or crack, compared to concrete, and other prior art materials. Thus the present invention not only functions as a gravity wall but also functions as a structural wall and as a diaphragm wall.

The structural wall of this invention is held in place due to the engineered design in which all the components are interlocked and pinned together and alternate in position to form a crib or grid system. The structural components are manufactured of an injection molded plastic which may be reinforced with fiberglass or any other suitable, filamentary material. These components are interlocked to form a lightweight gridwork into which earth is usually filled.

Since the load bearing component of the earth filling is basically downward, the internal grid or crib structure functions to retain the earth in place without excessive outward force being placed on the overall structure, while downward, load bearing forces on the components are not excessive. Also, if a shift occurs in the foundation of the gridwork structure, due to subsistence, water absorption, earthquakes, landslides, or soil movement, etc., the gridwork components will deform or articulate, thereby compensating and reducing the risk of structural failure. Hence the structure of this invention gives rise to the term, 'gravity wall'.

Basically, the components of this invention include a system of lightweight (about four pounds for each component), reinforced, injection molded, plastic crossbeams, and interlocking stringers and fascias formed into a grid structure having reasonable rigidity, but with elasticity, flexibility and adjustability characteristics. The stringers are beam-shaped, such as an I-beam or H-beam, and configured for end fitting over a cross beam. The end fitting around the crossbeams and the interfit of the stringer into the crossbeam provide structural continuity and integrity to the gridwork.

Additional horizontal adjustability of the structure arises by virtue of the connection between the crossbeams and the stringers. The cross beams define a slot and hole arrangement into which the molded pivot on the stringers are inserted, with a locking means being provided to connect the stringers and crossbeams to each other. Certain of the cross beams are provided with slots instead of holes, and these crossbeams are coursed back into the wall. The slots enable a concave or convex curvature to be imparted to the retaining wall and this permits the structure to follow property lines, curved frontage lines, etc., besides the usual straight lines.

The combination of slots and holes in the crossbeams and engaging corresponding pivots in the stringers, the use of locking pins which secure the stringers together, the use of pinned joints which still can articulate, the use of alternating components in the structure, and the inherent elasticity and flexibility of the plastic material of the components, produce a 'diaphragm wall' and enables the structure to articulate, thereby accommodating for minor changes in soil movement due to cracking, subsistence, upheaval, and earthquakes, as well as temperature variations.

BRIEF DESCRIPTION OF THE DRAWINGS

FIG8. 14A and 14B are respective external respective views of fascia plates used for corner construction in the grid system of this invention; and, FIGS. 15, 16 and 17 are plan views of the gridwork showing various embodiments of corner constructions.

DESCRIPTION OF THE PREFERRED EMBODIMENTS

Figure 1:
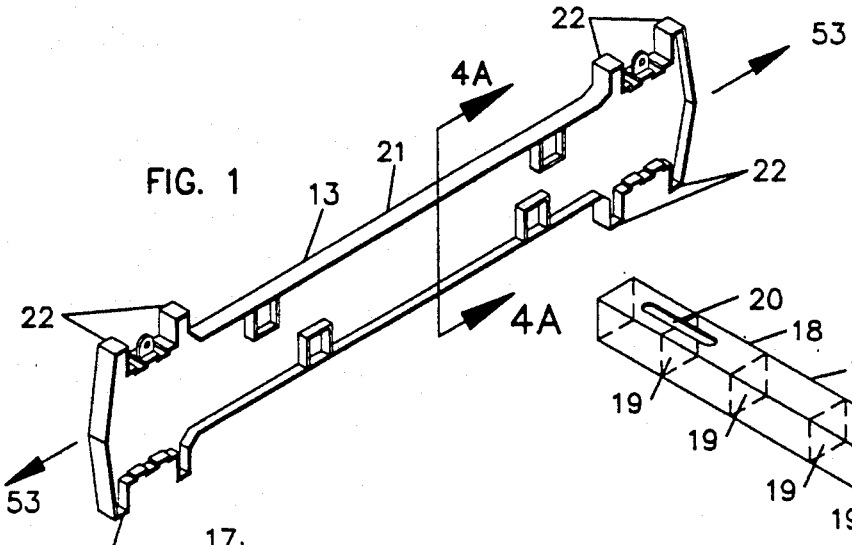
FIGS. 1, 2A, 2B and 3 are external, perspective views of a stringer, long and short crossbeam components and fascia, respectively of the invention, and their interlocking relationship.

The structure 10 of this invention is shown in FIGS. 8, 9, 10 and 11, and comprises a gridwork of injection molded long crossbeams 11 and short crossbeams 12 interlocked with stringers 13 and fascias 14. A typical long crossbeam 11 is shown in greater detail in FIGS. 2A and 4A, and comprises a U-shaped, rectangular cylinder 15 with integrally formed reinforcing panels 16. Holes 17, two of which are shown, are provided on both the upper and lower sides of the long crossbeam to enable interfitting with the stringer 13, by means of a pivot pin 26, infra, as shown in FIG. 1.

The stringers and crossbeams components of this invention are easily manufactured of conventional plastics such as PVC, high density polyethylene, polypropylene, etc. Obviously, other plastic materials which may be developed in the future may be used, where suitable. A present production size of stringer 13 is about 2"×12"×48", and weighs about four pounds; a long cross beam 11 is about 4"×4"×48" and weighs about four pounds; and a short cross beam 12 is sized about 4"×4"×38", and weighs about three pounds. The components have a wall thickness of approximately 3/16 inches. By comparison, the same size of concrete components weigh in the order of about 125 pounds. The present production sizes of the components were selected as convenient and economical, however, a large range of component sizes could be readily manufactured.

Figure 2B:
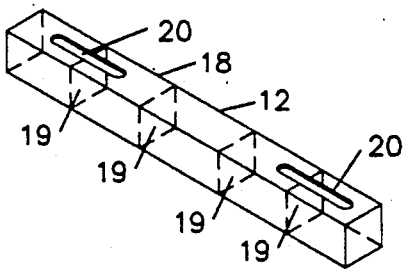
Figure 2A:
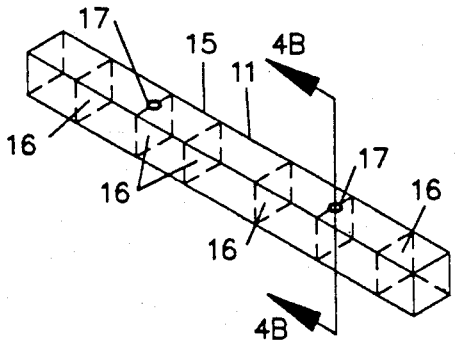
Figure 3:
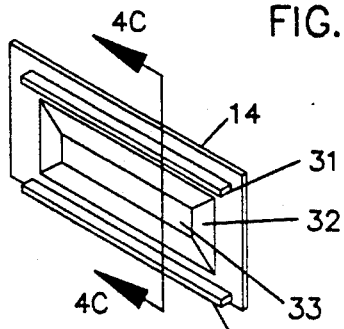

A typical short crossbeam 12 is shown in greater detail in FIG. 2B, and comprises a U-shaped rectangular cylinder 18 having integrally formed reinforcing panels 19 and elongated slots 20 on both the upper and lower sides of the short crossbeam. This arrangement enables interfitting of a crossbeam with a stringer 13 by means of a pivot pin 26, and it will be apparent that the crossbeam and stringer can move relative to each other along the slots 20. The fascia 14 is shown in FIGS. 3 and 4C, and comprises a rectangular flat plate with two ribs 31 on the front, a rectangular dish 32 and a flat open area 33. An awning portion 34 is formed on the rear of the fascia (FIGS. 4C and 7) and functions to shield the open area 33 from movement of earth therethrough.

Figure 6:
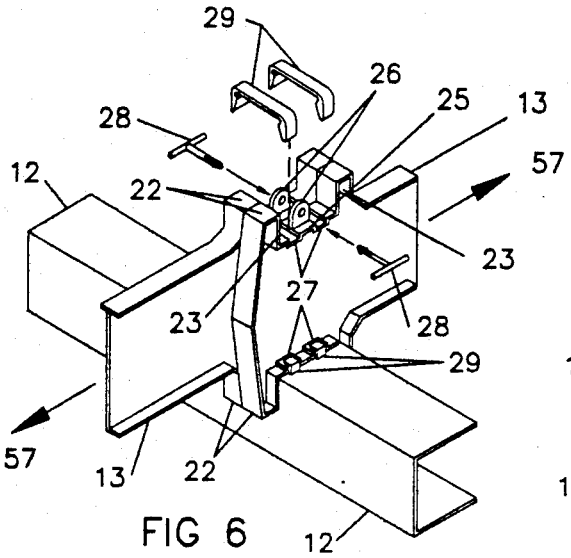
FIG 6. is an external, perspective view of two interlocked stringers and a crossbeam showing the connection between the stringers by means of T-pins and clips.
Figure 7:
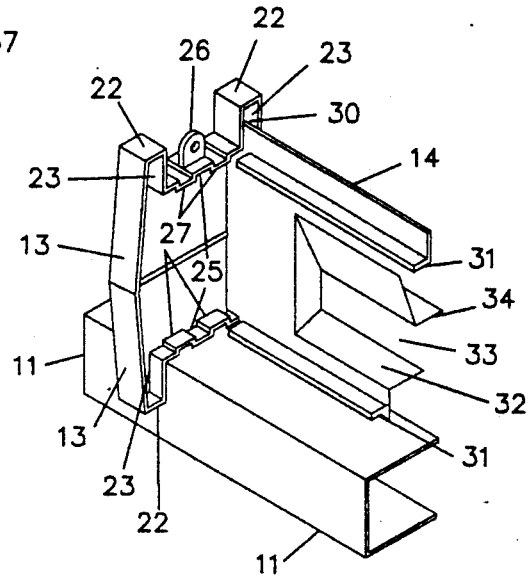
FIG. 7. is an external perspective view of a mounted stringer and crossbeam showing a portion of a fascia plate which may be employed in the front of the grid structure.

The stringer 13 is shown in greater detail in FIGS. 1, 4B, 6 and 7, and comprises an elongate body 21 with an I-beam cross section and U-shaped end members 22. As shown in FIGS. 6 and 7, when assembled, the end members 22 function to partially envelope the sides of the cross beams 11 and 12, and assist in rigidifying the gridwork structure 10.

Figure 5A:
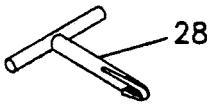
FIGS. 5A and 5B are external perspective views, respectively of a T-pin and clip used to secure adjacent stringers together.
Figure 5B:
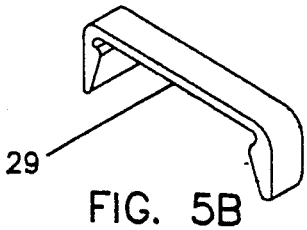

As shown in FIGS. 6 and 7, the end members 22 comprise integrally formed upper and lower upstanding retainer sections 23 and intermediate floor portions 24. Each floor portion comprises a central ridge 25, bearing a pivot pin 26, and adjacent channel portions 27; only the upper retainer sections are shown. The stringers are then locked together by means of T-pins 28, one of which is shown in detail in FIG. 5A.

As shown in FIG. 6, the channel portions 27 are sized to receive clips 29, which are used to stabilize two stringers 13, following locking by the T-pins 28, when they are placed end-to-end and side-by-side to form additional courses of gridwork. Four clips 29 are shown in FIG. 6 connecting two stringers 13, and this locking arrangement enables lateral shear strength to be imparted to the stringers 13.

Figure 8A:
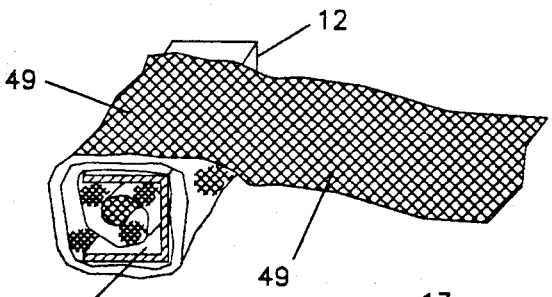
FIG. 8A is a view in side elevation, partly in perspective, showing the use of an earth-locking sheet to improve stability of the girdwork system.
Figure 8B:
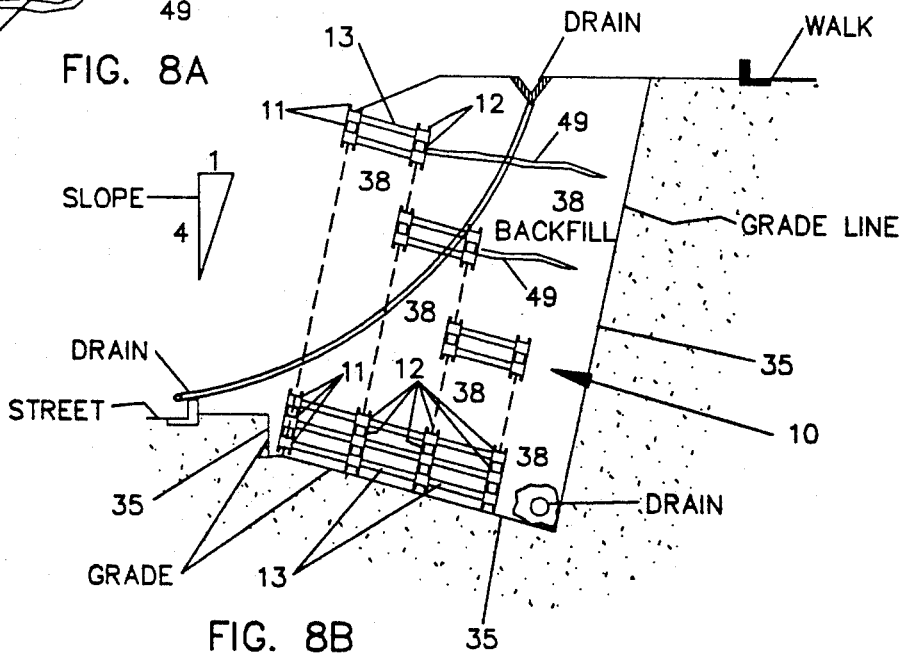
FIG. 8B is a sectional view of a typical retaining wall employing the gridwork system of this invention as a gravity wall, three courses deep and several tiers high.

As shown in FIG. 8, to construct a retaining wall using the present invention, initially a ground base is first graded 35, followed by say installing a drainage system , and then forming the gridwork structure 10. For a 'gravity wall' method of construction, a ground base is graded on a 1:4 reverse incline, which is approximately 15 degrees. This reverse incline places more weight of the earth in a lower or gravity position.

Figure 9:
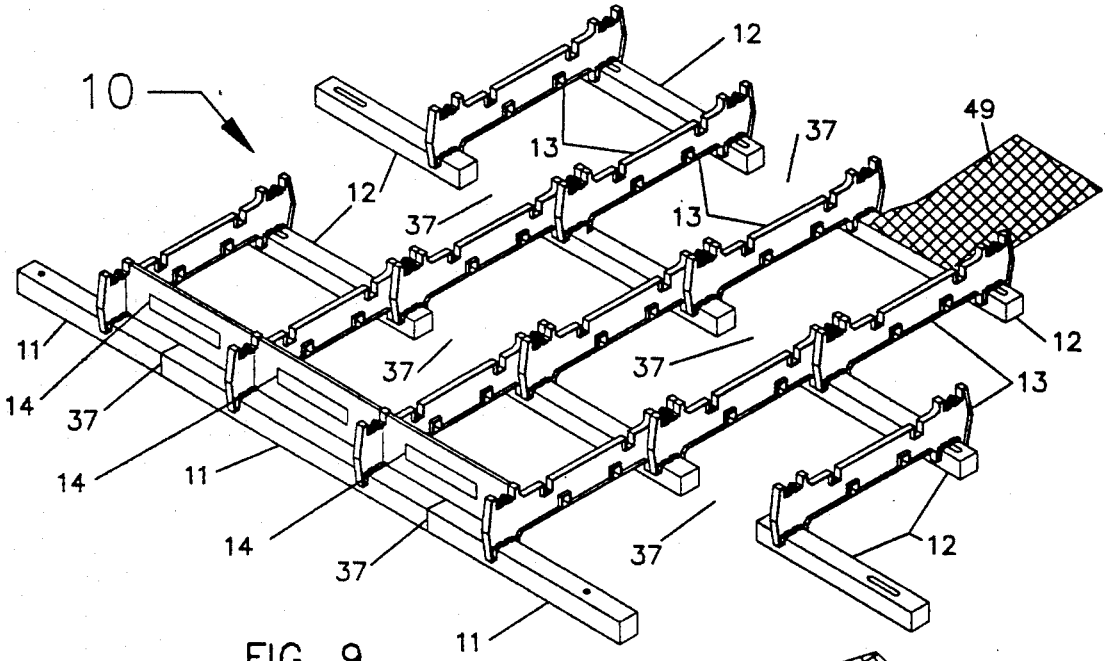
FIG. 9. is an external, perspective view of a partially assembled gridwork structure, one tier high and three courses deep, according to the invention.

FIG. 9 shows the initial construction which is one tier high and three courses deep, and involves laying out the long cross beams 11 to form the front perimeter of a wall or earth retaining structure followed by laying out the short cross beams 12. The centers of the short cross beams 12 are directly behind the joints 37 between each long cross beam 11. By alternating the joints 37 as the crossbeams 12 progress into the wall by courses, and alternating the joints as the cross beams 11 and 12 are stacked in successive tiers, a structural gridwork system is formed where all components are interconnected. Crib channels 36 are formed internally in the gridwork and function to contain the retained earth into discrete columns. This prevents the retained earth from moving as a single mass, that might otherwise overload a portion of the gridwork.

Figure 10:
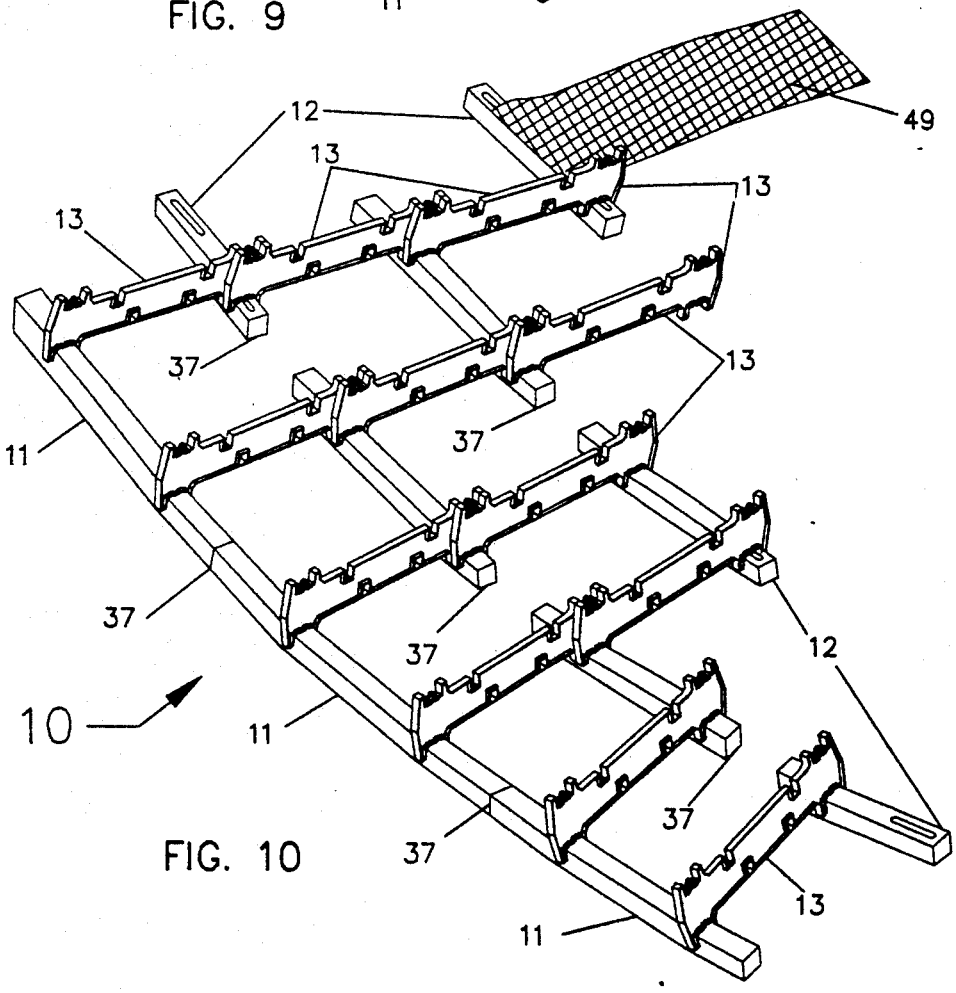
FIG. 10. is an external perspective view of the grid system of this invention one tier in height and three courses deep when employed as a convex wall.

The stringers 13 are then installed between the cross beams 11 and 12. This involves inserting the stringer pivot pins 26 into the holes 17 and slots 20 of the cross beams, as shown in FIGS. 1, 2 and 3. Since the slots 20 are longer than the smaller pivot pins 26, the pivot pins can move along the slots, and hence, the grid structure can be formed in various types of curves so that it can follow along ground contours, straight lines, etc., to form convex, concave or straight walls, as shown in FIG. 10.

FIG. 6 shows the stringers connected together by inserting T-pins 28 into the pivot pin holes on all the stringers, i.e., four T-pins (two on the top and two on the bottom) for each stringer, and clips 29 are then snapped into the channel portions 27 at every side-by-side stringer. The structure 10 is then continued, shown in FIGS. 8, 9, 10 and 11 by laying courses and stacking tiers until the pre-designed retaining wall has been completed. Back filling with back fill 38 and tamping are accomplished on a continuous basis as every one or two tiers are installed.

FIGS. 7 and 9 show the fascias 14 which function to assist in stabilizing the earth enclosed in the gridwork. The fascias are installed between the stringers by fitting them into the recesses 30 of the stringers. The fascias define strengthening ribs 31 which rest both on top of, and below a crossbeam 11, thereby supporting and spacing the crossbeams; the ribs 31 also prevent earth from sifting out of the wall. The fascias can be open 33 to allow vegetation to grow therethrough and present a pleasing appearance, or alternatively, the fascias can be molded without the opening 33, if vegetation is not desired.

Figure 12A:
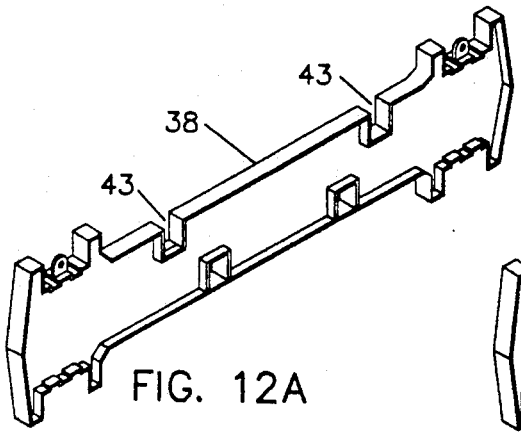
FIGS. 12A and 12B are external perspective views of a notched stringer and half stringer, both being used for interfitting into each other to provide a corner construction in the grid system of this invention.
Figure 14A:
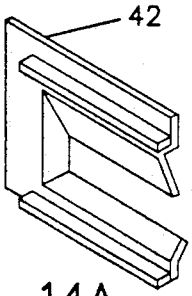
Figure 14B:
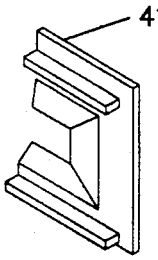

Square corners can be formed with the molded plastic components of this invention. Special configurations (FIGS. 12A and 12B) of the stringer 38 and 39, cross beam 40 (FIG. 13.) and fascias 41 and 42 (FIGS. 14A and 14B) are used for a corner construction. These components form an interlocked gridwork system by physically fitting and pinning components 38, 39, 40, 41 and 42 together, unlike concrete or wood components which use only gravity to maintain their assembly.

Figure 12B:
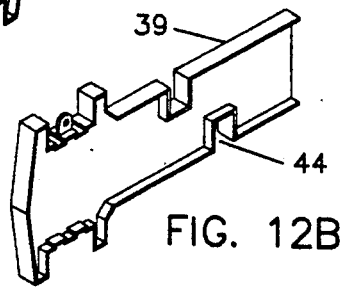
Figure 13:
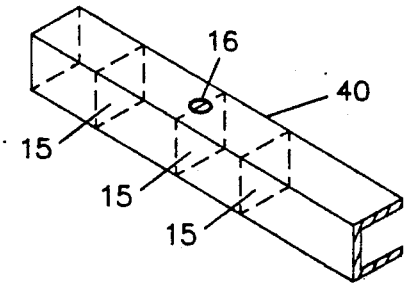
FIG. 13. is an external perspective view of a crossbeam half used for interfitting into a notched stringer to provide a corner construction in the grid system of this invention.
Figure 15:
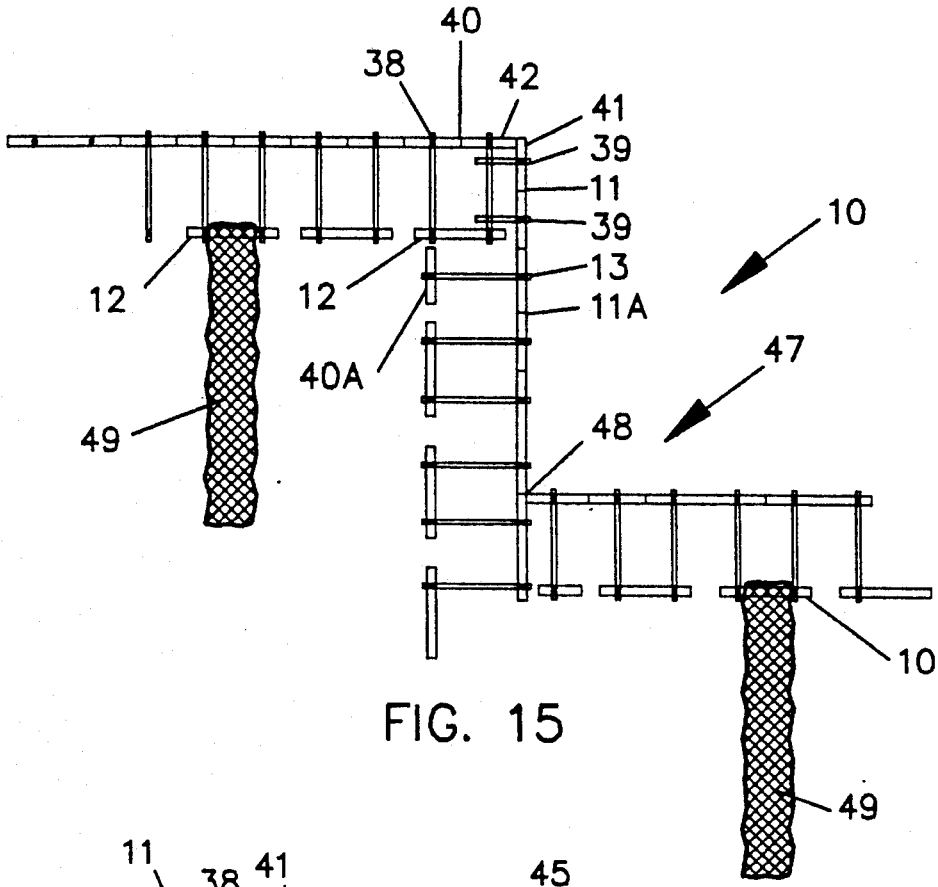

FIG. 15 shows an outside 90 degree corner which is constructed by starting on the 1st, or bottom most tier, and all odd numbered tiers, i.e, 3rd, 5th, etc., are similarly constructed. For this purpose, a cross beam half 40 is substituted for the normal long crossbeam 11 in front of the wall where the corner is desired. A stringer 38, with two notches 43 (FIG. 12A) is assembled and pinned to the cross beam half 40. At the rear of this stringer 38 a normal short cross beam 12 is assembled and pinned together. A cross beam long 11 is placed at 90 degrees at the end of the cross beam half 40. Two stringer halves 39 are assembled to this 90 degree long crossbeam 11. The notch 44, as shown in FIG. 12B, on each stringer is fitted into its corresponding notch 43 (FIG. 12A) on the stringer notch. The fascia corner piece 42 is fitted into the front of the wall and the fascia corner piece 41 is fitted into the 90 degree side of the wall. A second long crossbeam 11A is placed end-to-end with the long cross beam 11 that is forming the 90 degree corner. A stringer 13 is pinned on top of the long cross beam 11A and a cross beam half 40A is pinned underneath the rear of stringer 13. This configuration completes the 1st and all odd numbered tier assemblies for a 90 degree corner. The retaining wall on odd numbered tiers is then continued in both 90 degree directions using a straight wall method of assembly.

Figure 16:
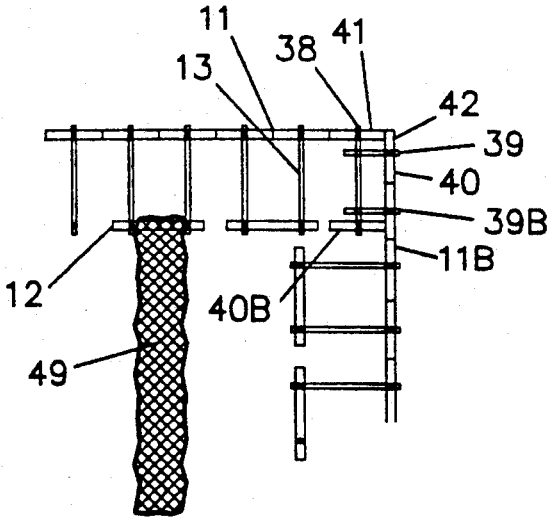

FIG. 16 shows a 90 degree corner on the 2nd, 4th, 6th and all even numbered tiers which are constructed by assembly and pinning together a series of three crossbeams. Initially, a long crossbeam 11 is assembled on top of the crossbeam half 40 and the notch stringer 38 that were assembled as part of the lower 1st tier. This long cross beam will extend to the last stringer 13 of the front wall on the 1st tier. A second cross beam half 40 is placed at 90 degrees to, and at the end of, this first long cross beam 11. An additional, long cross beam 11B is then placed end-to-end to the 90 degree cross beam half 40. A notched stringer 38 is assembled on top of the long cross beam 11 on the front wall, and a cross beam half 40B is assembled underneath the rear of this notched stringer. A stringer half 39 is assembled on top of the 90 degree crossbeam half 40 and its end-to-end long cross beam 11. A second half stringer 39B is assembled on top of the cross beam 11B and stringer 38. The rear of these two stringer halves define notches 44 which are fitted into the notches 43 of the stringer 38.

FIG. 16 also shows a fascia corner (two pieces 41 and 42) which are fitted in a reverse manner to that of the 1st tier. The fascia corner piece 42 is fitted into the 90 degree side of the corner and the fascia piece 41 is fitted into the front of the wall. This completes the 2nd, and all even numbered tiers for a 90 degree corner. The retaining wall on the even numbered tiers is then continued in both 90 degree directions as a straight wall method of assembly.

Figure 17:
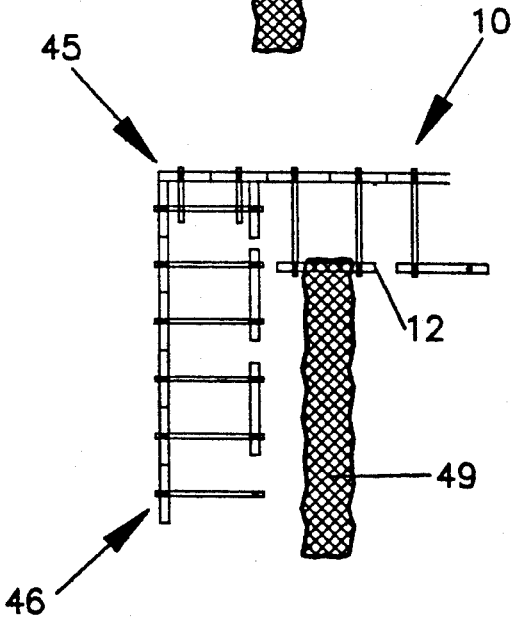

FIG. 17 shows both ends 45 of a retaining wall that should, in the preferred design, taper down to a height that does not leave an open end to the wall, which otherwise would court failure. In the preferred wall design, both ends of the wall should provide a 90 degree outside corner extending back into wall 46 at least as far as the height of the wall end.

An inside 90 degree corner 47 (FIG. 15.) is constructed by overlapping one of the intersecting walls. The overlap 48 should be sufficient so that the wall which is overlapped does not have side or end pressure but is only required to retain the rear tension pressure.

Figure 11:
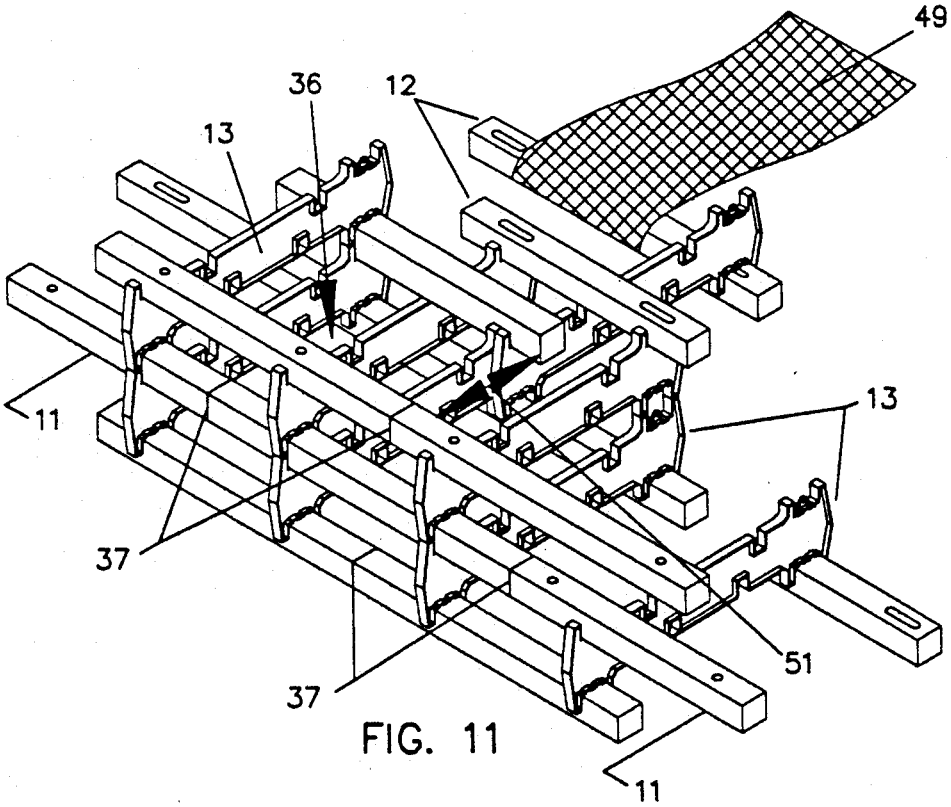
FIG. 11. is an external view of the grid system of this invention three tiers high and two courses deep showing the crossbeams connected in alternating fashion, and the earth retaining cribs formed by the grid system.

If desired, the gridwork structure may be secured into the earth either within or adjacent the structure, as shown in say FIGS. 9, 10 and 11. For this purpose, a coarsely woven sheet 49, typically of plastic material, is wrapped one or more times around one or a plurality of stringers 12 and then extended for an appropriate distance into the earth in and/or adjacent to the gridwork structure. Backfill dirt applied on top of the plastic sheet will penetrate and then interlock with the sheet. The weight of the dirt combined with the interlock will produce a strong frictional force to secure the sheet against lateral movement, thereby further immobilizing the gridwork structure. This optional method may be utilized by the design engineer, depending on the nature of the retaining wall and overall requirements.

When the production components of the gridwork system 10 of this invention were tested by applying pressure in the directions 51 as shown by the arrows in FIG. 11, a force in excess of 10,000 pounds was required to produce failure. In the test, a measured twenty inches of the stringer 13 was stretched over two inches. Notwithstanding, the failed stringer nevertheless returned to its normal configuration of twenty inches upon conclusion of the test. Thus the test indicated both an adequate elasticity of the plastic material, and also an adequate design of the component and gridwork system.

In another test, by applying pressure to the stringer component 13, as shown by the directions 53 of the arrows in FIG. 1, failure of this component exceeded 4,800 psi. The failure occurred at holes drilled in the beam portion of the stringer to accommodate for test holding fixtures.

Figure 4A:
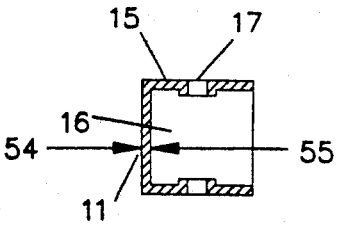
FIGS. 4A, 4B, and 4C are sectional views of a stringer, cross beam, and fascia taken along lines 4A, 4B, and 4C, respectively of FIGS. 1, 2 and 3.
Figure 4B:
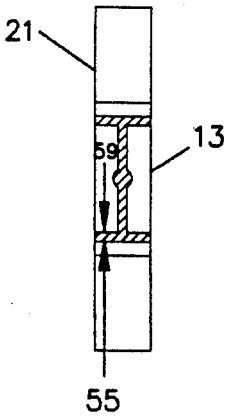
Figure 4C:
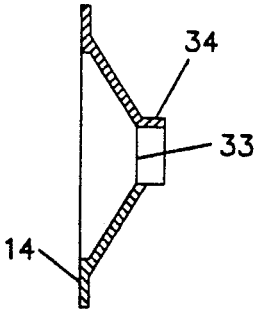

As indicated in FIGS. 4A and 4B, the test forces that were applied in the directions shown by the arrows 54 and 55 and that were required to shear a section of a production component, exceeded 2,000 psi. However, the configuration of the component, and the elasticity of the material used would enable the component to flex and bend long before the shear limit is reached. Hence, in actual use, the failure mode would be that of breaking, rather than shearing.

As shown in FIG. 6, the tested lateral forces 57 applied in the directions of the arrows and which were required to separate an unrestrained joint, exceeded 850 pounds, at which level the clips 29 became disengaged. In actual use, it is considered that these lateral forces required to produce failure would be much greater, both because the joint would be part of a larger pinned wall system, and also because the joint would be restrained by the earth backfill.

All tests were conducted using high density polyethylene having a low flow modulus, employing 15% by weight of fiberglass reinforcement, and with the production components having the dimensions described, supra.

The use of reinforced plastic material has obvious advantages such as lightness in weight, which enables ease of transportation to inaccessible sites and during construction. Also, the plastic material employed is resistant to rot, alkali, and insect infestation, and U.V. deterioration is considerably reduced due to the use of anti-oxidants and U.V. inhibitors, and additionally because a large portion of the gridwork is buried. The selection of a specific plastic depends on its resistance to sunlight, U.V. and oxidation, in addition to strength. Although the components may be molded in any color, hue or shade, the preferred colors are black and green because these colors also reduce the effects of ultra violet sunlight.

I claim:

1. A gridwork structure suitable for retaining walls, and the like, comprising:

A. a stringer component defining a flexible, beam-shaped cross section, and U-shaped end portions, each end portion defining lockable pivot pin means, adjacent stringers being locked together at their respective adjacent pivot pins;

B. a first crossbeam component providing flexible, upper and lower sides and a connecting intermediate wall, thereby defining a hollow, U-shaped structure, and reinforcing members therebetween, the upper and lower sides defining slots for sliding, adjustable interfitting with the pivot pins of adjacent stringers;

C. a second crossbeam component providing flexible, upper and lower sides and a connecting intermediate wall, thereby defining a hollow, U-shaped structure, and reinforcing members therebetween, the upper and lower sides defining holes for interfitting with the pivot pins of the stringers, the U-shaped end portions of the stringers partially enveloping an interlocking crossbeam; whereby, when the stringer and crossbeam components are assembled:

i. a gridwork structure is formed defining a plurality of internal, vertically oriented crib channels which retain earth or land fill, for stabilization into discrete columns;

ii. an articulating interfitting is formed between the stringers and crossbeams, thereby enabling the structure:

a.) to conform to ground contours and changes thereof;

b.) to be adjustable for following variations in terrain; and, c.) to elastically deform in response to changes of internal pressure caused by retained earth or land fill; and, iii. the locked adjacent stringers impart rigidity to the grid structure, and shear resistance is imparted to the stringers.

2. The gridwork structure of claim 1, comprising a fascia element mounted in a space defined by adjacent stringers and crossbeams, and interlocked therewith, thereby reinforcing the said structure.

3. The gridwork structure of claim 2, including crossbeams and interlocking, notched stringers, and a corner portion of the structure formed thereby.

4. The gridwork structure of claim 1, including a plastic fabric wrapped around a stringer or crossbeam component, the fabric being adapted to penetrate and interlock with backfill or earth which has penetrated therethrough, thereby stabilizing the fabric against lateral movement and further immobilizing the said structure.

5. The gridwork structure of claim 1, in which the said pivot pin means defines a bore, and adjacent stringers are interlocked by a retaining pin inserted into the bores of corresponding, adjacent pivot pins.

6. The gridwork structure of claim 5, comprising clip means securing adjacent pivot pins and their retaining pins.

7. The gridwork structure of claim 1, in which the stringer component, first crossbeam component and second crossbeam component are constructed of a plastic selected from the class consisting of PVC, polyethylene and polypropylene.

8. The gridwork structure of claim 7, in which the said plastic contains a fibrous reinforcement.

9. The gridwork structure of claim 8, in which the said plastic contains a filler to impart U.V. and anti-oxidant resistance.

10. The gridwork structure of claim 1, in which the reinforcing members of the crossbeam components comprise integrally formed panels.

11. The gridwork structure of claim 1, in which the stringer has a wall thickness of approximately 3/16 inches, and weighs about four pounds, the first crossbeam has a wall thickness of approximately 3/16 inches, and weighs about three pounds, and the second crossbeam component has a wall thickness of about 3/16 inches and weighs about four pounds.

12. A method of assembling a plurality of interlocking stringer and crossbeam components to form a gridwork structure for retaining walls, and the like, the said components, comprising:

A. a stringer plastic component defining a flexible, beam-shaped cross section, and U-shaped end portions, each end portion defining lockable pivot pin means, adjacent stringers being locked together at their respective adjacent pivot pins;

B. a first plastic crossbeam component providing flexible, upper and lower sides and a connecting intermediate wall, thereby defining a hollow, U-shaped structure, and reinforcing members therebetween, the upper and lower sides defining slots for sliding, adjustable interfitting with the pivot pins of adjacent stringers;

C. a second plastic crossbeam component providing flexible, upper and lower sides and a connecting intermediate wall, thereby defining a hollow, U-shaped structure, and reinforcing members therebetween, the upper and lower sides defining holes for interfitting with the pivot pins of the stringers, the U-shaped end portions of the stringers partially enveloping an interlocking crossbeam; the method comprising, assembling the stringer and crossbeam components, thereby:

i. forming a gridwork structure defining a plurality of internal, vertically oriented crib channels which retain earth or land fill, for stabilization into discrete columns;

ii. forminq an articulating interfitting between the stringers and crossbeams, thereby enabling the structure:

a.) to conform to ground contours and changes thereof;

b.) to be adjustable for following variations in terrain; and, c.) to elastically deform in response to changes of internal pressure caused by retained earth or land fill; and, iii. locking adjacent stringers, thereby imparting rigidity to the grid structure, and imparting shear resistance to the stringers.

13. The method of claim 12, in which the gridwork structure includes fascia elements mounted in a space defined by adjacent stringers and crossbeams, and interlocked therewith, thereby reinforcing the said structure.

14. The method of claim 13, including crossbeams and notched stringers for interlocking therewith, and a corner portion of the structure formed thereby.

15. The method of claim 12, including a plastic fabric wrapped around a stringer or crossbeam component, whereby earth or backfill will penetrate and interlock with the fabric, thereby stabilizing the fabric against lateral movement and further immobilizing the said structure.

16. The method of claim 12, in which the said pivot pin means defines a bore, and adjacent stringers are interlocked by a retaining pin inserted into the bores of corresponding, adjacent pivot pins.

17. The method of claim 16, comprising clip means securing adjacent pivot pins and their retaining pins.

18. The method of claim 12, in which the plastic is selected from the class consisting of PVC, polyethylene and polypropylene.

19. The method of claim 12, in which the reinforcing members of the crossbeam components comprise integrally formed panels.

20. The method of claim 11, in which the stringer has a wall thickness of approximately 3/16 inches, and weighs about four pounds, the first crossbeam has a wall thickness of approximately 3/16 inches, and weighs about three pounds, and the second crossbeam component has a wall thickness of about 3/16 inches and weighs about four pounds.

* * * * *